US008625814B2

(12) United States Patent
Yang et al.

(10) Patent No.: US 8,625,814 B2
(45) Date of Patent: Jan. 7, 2014

(54) EARPHONE ANTENNA OF A PORTABLE TERMINAL

(75) Inventors: Jun Young Yang, Suwon-si (KR); Min Cho, Hwaseong-si (KR); Byoung Hee Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 428 days.

(21) Appl. No.: 13/099,668

(22) Filed: May 3, 2011

(65) Prior Publication Data

US 2011/0274285 A1 Nov. 10, 2011

(30) Foreign Application Priority Data

May 10, 2010 (KR) ..... 10-2010-0043478

(51) Int. Cl.
*H04R 1/10* (2006.01)

(52) U.S. Cl.
USPC ..... 381/74; 381/77; 381/370; 381/384; 455/562.1; 455/575.7

(58) Field of Classification Search
USPC ..... 381/74, 77, 370, 375, 376, 384; 455/562.1, 575.1, 575.2, 575.7; 343/702, 718; 439/638, 668, 669
See application file for complete search history.

(56) References Cited

U.S. PATENT DOCUMENTS 7,671,813 B2 * 3/2010 Yoshino et al. ..... 343/718

* cited by examiner

*Primary Examiner* — Vivian Chin
*Assistant Examiner* — Paul Kim
(74) *Attorney, Agent, or Firm* — Jefferson IP Law, LLP

(57) ABSTRACT

An earphone antenna of a portable terminal having enhanced reception sensitivity even when a wearing state of the earphone of the mobile terminal is changed is provided. The earphone antenna includes a plurality of voice signal lines, an insulating sheath configured to cover an outer surface of the plurality of the voice signal lines, a receptacle configured to connect to a first end of each of the plurality of the voice signal lines, and a ground and antenna line including a first antenna line configured to wind around an outer surface of the insulating sheath at a first interval in a spiral form, the first antenna line having a first thickness, wherein the ground and antenna line includes a second antenna line configured to wind around an outer surface of the receptacle at a second interval in the spiral form, the second antenna line having a second thickness that is greater than the first thickness and the second interval being different from the first interval.

10 Claims, 4 Drawing Sheets

EARPHONE ANTENNA OF A PORTABLE TERMINAL

PRIORITY

This application claims the benefit under 35 U.S.C. §119 (a) of a Korean patent application filed on May 10, 2010 in the Korean Intellectual Property Office and assigned Serial No. 10-2010-0043478, the entire disclosure of which is hereby incorporated by reference.

BACKGROUND OF THE INVENTION

1. Field of the Invention

The present invention relates to an earphone antenna of a portable terminal. More particularly, the present invention relates to an antenna built in an earphone that can be connected to a portable terminal.

2. Description of the Related Art

Recently, in response to customers' high demand and with the development of information, communication, and semiconductor technologies, portable terminals are capable of providing Digital Multimedia Broadcasting (DMB) services. In order to display DMB channels, an antenna is needed to receive a DMB signal. Conventionally, an attachable/detachable antenna is mainly used for receiving the DMB signal while an earphone antenna replacing the attachable/detachable antenna is just beginning to be used.

FIG. 1 is a plain view illustrating a configuration of an earphone antenna of a portable terminal according to the related art.

Referring to FIG. 1, an earphone antenna 1 in a portable terminal is described. The earphone antenna 1 of the portable terminal includes a plurality of voice signal lines 10*a* and 10*b*, an insulating sheath 16 and an antenna line 18. Insulators 12*a* and 12*b* cover outer surfaces of the voice signal lines 10*a* and 10*b*, respectively, and a ground line 14 covers outer surfaces of the insulators 12*a* and 12*b*. The insulating sheath 16 covers an outer surface of the ground line 14 and the antenna line 18 having a given thickness θ winds around an outer surface of the insulating sheath 16 in a spiral form and at a given interval/width (WTH). An insulating jacket 5 covers an outer surface of the antenna line 18.

In the earphone antenna of the portable terminal described above, because the antenna line is formed on an entire earphone line at the given WTH, reception sensitivity can be greatly lowered depending on how the earphone is shaped according to a wearing state thereof.

Therefore, a need exists for an earphone antenna of a portable terminal having enhanced reception sensitivity even when a wearing state of the earphone of the mobile terminal is changed.

SUMMARY OF THE INVENTION

An aspect of the present invention is to address at least the above-mentioned problems and/or disadvantages and to provide at least the advantages described below. Accordingly, an aspect of the present invention is to provide an earphone antenna of a portable terminal having enhanced reception sensitivity even when a wearing state of the earphone of the mobile terminal is changed.

According to an aspect of the present invention, an earphone antenna of a portable terminal is provided. The earphone antenna includes a plurality of voice signal lines, an insulating sheath configured to cover an outer surface of the plurality of the voice signal lines, a receptacle configured to connect to a first end of each of the plurality of the voice signal lines, and a ground and antenna line including a first antenna line configured to wind around an outer surface of the insulating sheath at a first interval in a spiral form, the first antenna line having a first thickness, wherein the ground and antenna line include a second antenna line configured to wind around an outer surface of the receptacle at a second interval in the spiral form, the second antenna line having a second thickness that is greater than the first thickness and the second interval being different from the first interval.

According to another aspect of the present invention, an earphone antenna of a portable terminal is provided. The earphone antenna includes a plurality of voice signal lines, an insulating sheath configured to cover an outer surface of the plurality of the voice signal lines, a receptacle configured to connect to a first end of each of the plurality of the voice signal lines, and a ground and antenna line including a first antenna line configured to wind around an outer surface of the insulating sheath at a first interval in a spiral form, the first antenna line having a first thickness, wherein the ground and antenna line includes a second antenna line configured to wind around the outer surface of the insulating sheath that is adjacent to the receptacle at a second interval in the spiral form, the second antenna line having a second thickness that is greater than the first thickness and the second interval being different from the first interval.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiment of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Figure 2:
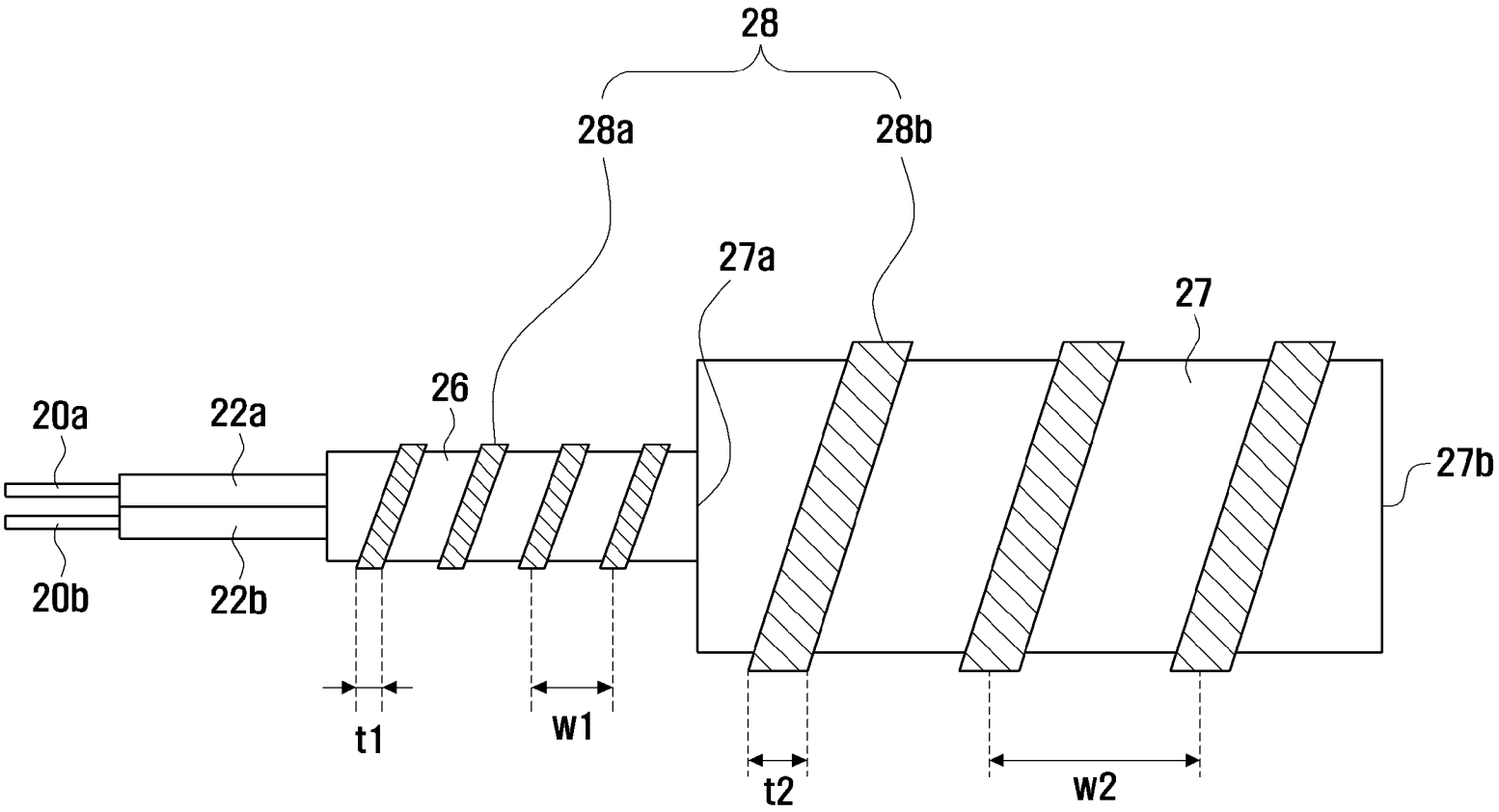
FIG. 2 is a plain view illustrating a configuration of an earphone antenna of a portable terminal according to an exemplary embodiment of the present invention.
Figure 3:
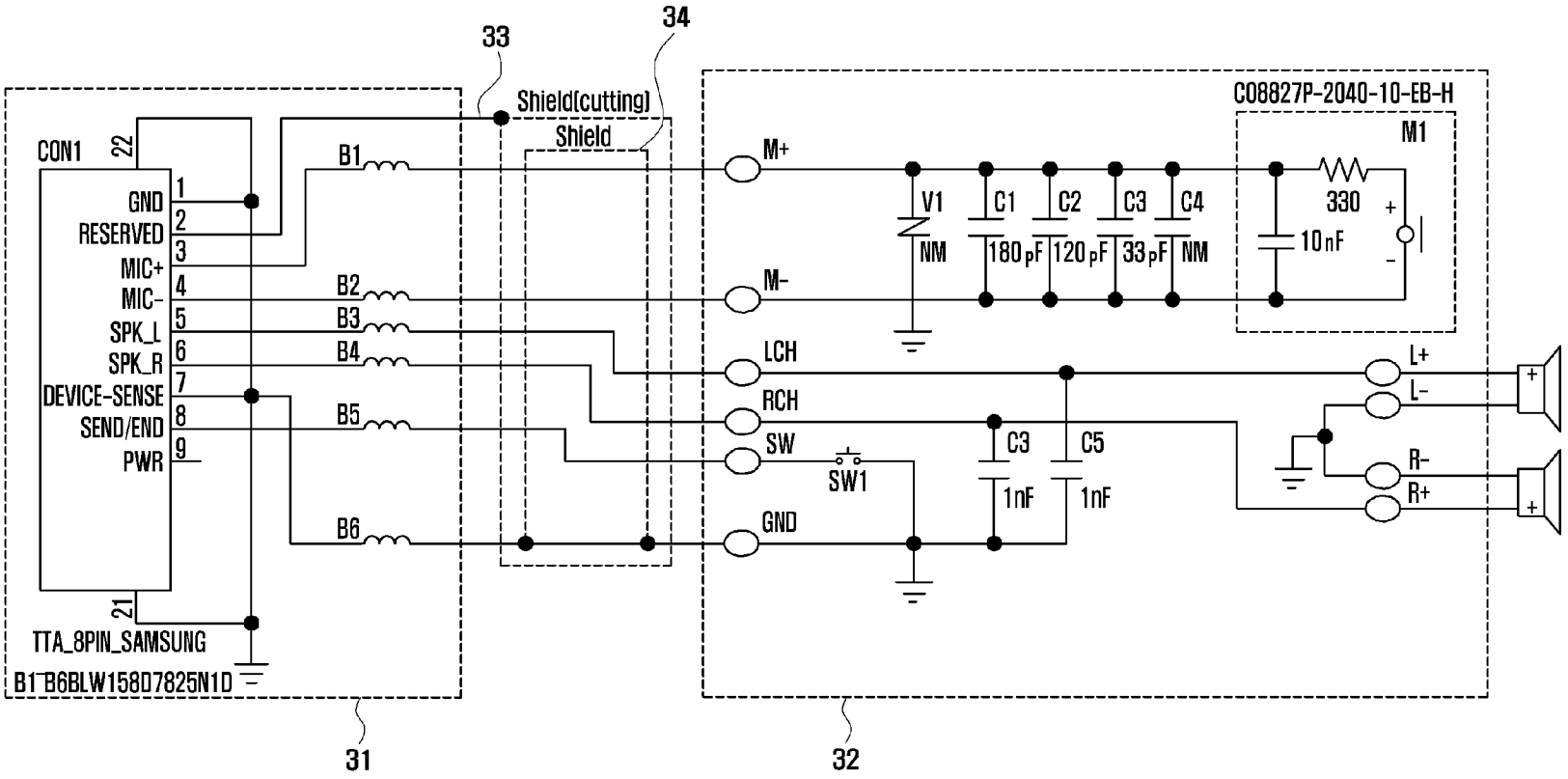
FIG. 3 is a circuit diagram illustrating a configuration of an earphone of a portable terminal which employs an earphone antenna according to an exemplary embodiment of the present invention.
Figure 4:
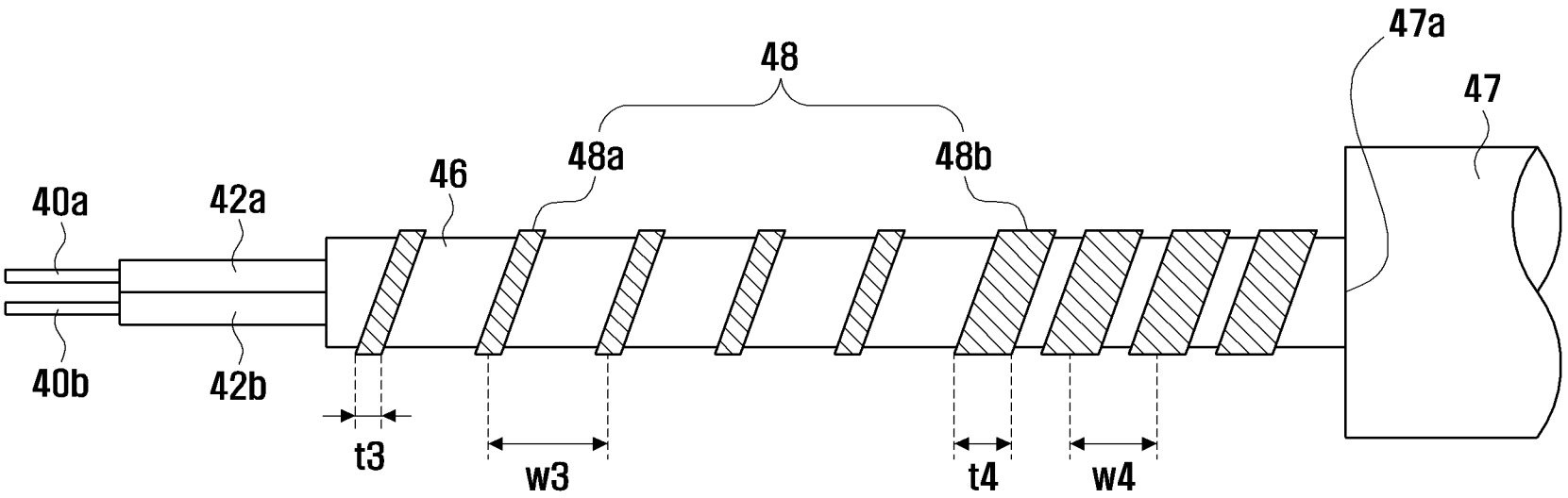
FIG. 4 is a plain view illustrating a configuration of an earphone antenna of a portable terminal according to an exemplary embodiment of the present invention.

FIGS. 2 through 4, discussed below, and the various exemplary embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the invention. Terms first, second, and the like are used to differentiate between objects having the same terminology and are in no way intended to represent a chronological order, unless where explicitly state otherwise. A set is defined as a non-empty set including at least one element.

FIG. 2 is a plain view illustrating a configuration of an earphone antenna of a portable terminal according to an exemplary embodiment of the present invention and FIG. 3 is a circuit diagram illustrating a configuration of an earphone of a portable terminal which employs an earphone antenna according to an exemplary embodiment of the present invention.

Referring to FIGS. 2 and 3, an earphone antenna of a portable terminal is described. The earphone antenna of the portable terminal includes a plurality of voice signal lines 20*a* and 20*b*, an insulating sheath 26, a receptacle 27 and a ground and antenna line 28.

The plurality of the voice signal lines 20*a* and 20*b* are located in a central part of the earphone antenna of the portable terminal. In FIG. 2, two voice signal lines are illustrated; however, it should be noted that three or more voice signal lines can be included. For example, as shown in FIG. 3, two microphones (MIC+, MIC−) (third and fourth pin lines) and two speakers (SPK_L, SPK_R) (fifth and sixth pin lines) can be used. Each of the voice signal lines 20*a* and 20*b* are covered by insulators 22*a* and 22*b*, respectively. As shown in FIG. 3, the plurality of the voice signal lines 20*a* and 20*b* are connected to a connector assembly 31, which is connected to a Printed Circuit Board (PCB) assembly 32 through shielded connectors 33 and 34.

The insulating sheath 26 covers outer surfaces of the plurality of the voice signal lines 20*a* and 20*b*, and one end of each of the plurality of the voice signal lines 20*a* and 20*b* is connected to one end 27*a* of the receptacle 27, which houses the PCB assembly 32. The other end 27*b* of the receptacle 27 can be detachably connected to an earphone line (not shown), or alternatively, connected to the earphone line as one body.

An antenna line according to an exemplary implementation is a ground and antenna line, which uses a ground line as an antenna line, such as a second pin line shown in FIG. 3. The ground and antenna line 28 includes a first antenna line 28*a* and a second antenna line 28*b* that are connected to each other. The first antenna line 28*a* having a first thickness t1 winds around an outer surface of the insulating sheath 26 at a first interval w1. The second antenna line 28*b* having a second thickness t2 winds around an outer surface of the receptacle 27 at a second interval w2, the second interval w2 being different from the first interval w1 and the second thickness t2 being greater than the first thickness t1. The second interval w2 is determined such that a resonance point of the ground and antenna line 28 is produced, i.e., matching a Voltage Standing Wave Ratio (VSWR) value close to 1:1. In FIG. 2, the second interval w2 is greater than the first interval w1. In FIG. 3, only the first antenna line of the ground and antenna line 28 is shown and the second antenna line is omitted for conciseness.

In the earphone antenna of the portable terminal according to an exemplary implementation, reducing a length of the earphone is possible because the second antenna line 28*b* covers the outer surface of the receptacle 27, even if the ground and antenna line 28 of the earphone antenna of the portable terminal has the same length as an antenna line of the conventional earphone antenna of the portable terminal.

FIG. 4 is a plain view illustrating a configuration of an earphone antenna of a portable terminal according to an exemplary embodiment of the present invention.

Referring to FIG. 4, an earphone antenna of a portable terminal includes, similar to the earphone antenna of FIG. 2, a plurality of voice signal lines 40*a* and 40*b*, an insulating sheath 46, a receptacle 47 and a ground and antenna line 48. Each of the voice signal lines 40*a* and 40*b* is covered by insulators 42*a* and 42*b*, respectively. In addition, the ground and antenna line 48 includes a first antenna line 48*a* and a second antenna line 48*b* that are connected to each other. The configuration of the earphone antenna of the portable terminal according to the earphone antenna of FIG. 4 is substantially similar to that of the earphone antenna of FIG. 2, except for some parts described below. The insulating sheath 46 covers outer surfaces of the plurality of the voice signal lines 40*a* and 40*b*, and one end of each of the plurality of the voice signal lines 40*a* and 40*b* is connected to one end 47*a* of the injection means 47.

Unlike the earphone antenna of FIG. 2, the second antenna line 48*b* of the earphone antenna of the portable terminal of FIG. 4 covers an outer surface of the insulating sheath 46 that is adjacent to the receptacle 47. However, similar to the earphone antenna of FIG. 2, a second thickness t4 is greater than a first thickness t3 and a first interval w3 is different from a second interval w4. The second interval w4 is determined such that a resonance point of the ground and antenna line 48 is produced. In FIG. 4, the second interval w4 is smaller than the first interval w3.

Although the earphone antenna of the portable terminal according to this exemplary implementation has the ground and antenna line 48 having a length same as the antenna line of the conventional earphone antenna of the portable terminal, the second antenna line 48*b* covers the insulating sheath 46 adjacent to the receptacle 47 at an interval smaller than the first interval, thereby resulting in a reduced length of the earphone.

Referring to Table 1 and Table 2 below, performances of the earphone antennas of the portable terminal according to the earphone antenna of FIG. 2 and the earphone antenna of FIG. 4 are compared with performances of the conventional earphone antenna of the portable terminal and an exclusive external antenna.

TABLE 1

Figure 1:
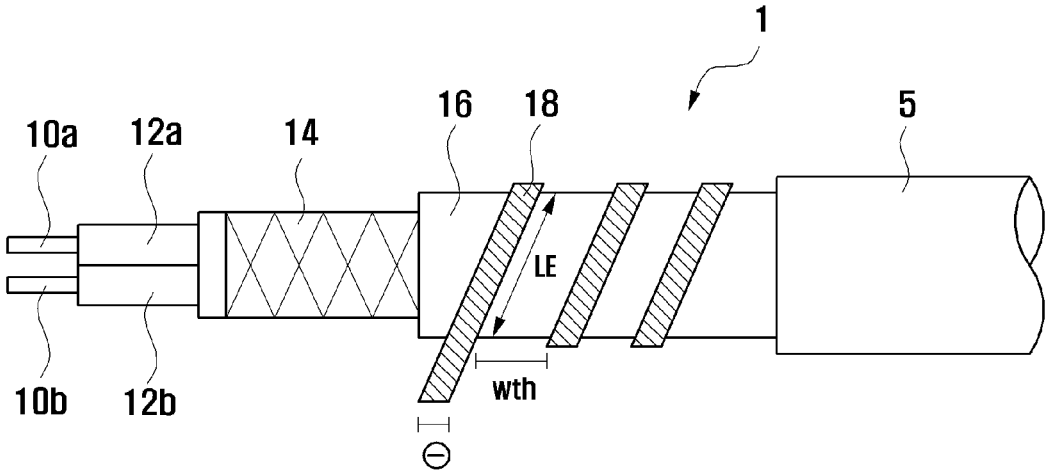
FIG. 1 (RELATED ART)
FIG. 1 is a plain view illustrating a configuration of an earphone antenna of a portable terminal according to the related art.

| Subject of Measurement | 8B Channel (YTN Broadcast) | 12B Channel (KBS STAR Broadcast) | Remarks |
|---|---|---|---|
| Exclusive External Antenna | −53 dBm | −60 dBm | |
| Conventional Earphone Antenna | −47 dBm | −50 dBm | Refer to FIG. 1 |
| Earphone Antenna of FIG. 2 | −53 dBm | −56 dBm | Refer to FIG. 2 |
| Earphone Antenna of FIG. 4 | −52.5 dBm | −55.5 dBm | Refer to FIG. 4 |

TABLE 2

| Subject of Measurement | 8B Channel (YTN Broadcast) | 12B Channel (KBS STAR Broadcast) | Remarks |
|---|---|---|---|
| Exclusive External Antenna | −58 dBm | −65 dBm | |
| Conventional Earphone Antenna | −54 dBm | −58 dBm | Earphone is worn in an ear |
| Earphone Antenna of FIG. 2 | −57 dBm | −63 dBm | Earphone is worn in an ear |

Table 1 represents reception sensitivity of a subject measured when the portable terminal is not gripped by a hand, and Table 2 represents reception sensitivity of the subject measured when the portable terminal is gripped by the hand. An increase in an absolute value of the reception sensitivity in a negative number indicates higher reception performance of the earphone antenna.

As shown in Table 1, in a case of the portable terminal that is not gripped by the hand, the earphone antenna of the portable terminal according to an exemplary embodiment of the present invention has enhanced performance than the conventional earphone antenna and shows reception performance not much lower than that of the exclusive external antenna. In addition, as shown in Table 2, when the portable terminal is gripped by the hand and the earphone is placed in an ear, the earphone antenna of the portable terminal according to an exemplary embodiment of the present invention has enhanced performance than the conventional earphone antenna and shows similar reception performance as that of the exclusive external antenna.

In addition, the earphone antenna of the portable terminal, according to an exemplary embodiment of the present invention, uses the ground and antenna line instead of using a separate antenna line, thereby reducing manufacturing costs compared with the conventional earphone antenna of the portable terminal shown in FIG. 1.

According to an exemplary embodiment of the present invention, by using the second antenna line having a thickness greater than that of the first antenna line and positioned on an outer surface of the receptacle or an outer surface of the insulating sheath adjacent to the receptacle at an interval different from that of the first antenna line, a higher reception sensitivity can be achieved even when a wearing state of the earphone of the portable terminal is changed.

While the invention has been shown and described with reference to certain exemplary embodiments thereof, it will be understood by those skilled in the present art that various changes in form and details may be made therein without departing from the spirit and scope of the present invention as defined by the appended claims and their equivalents.

What is claimed is:

1. An earphone antenna of a portable terminal, the earphone antenna comprising:

a plurality of voice signal lines;

an insulating sheath configured to cover an outer surface of the plurality of the voice signal lines;

a receptacle configured to connect to a first end of each of the plurality of the voice signal lines; and a ground and antenna line including a first antenna line configured to wind around an outer surface of the insulating sheath at a first interval in a spiral form, the first antenna line having a first thickness, wherein the ground and antenna line include a second antenna line configured to wind around an outer surface of the receptacle at a second interval in the spiral form, the second antenna line having a second thickness that is greater than the first thickness and the second interval being different from the first interval.

2. The earphone antenna according to claim 1, wherein the second interval is greater than the first interval.

3. The earphone antenna according to claim 1, wherein the second interval is determined such that a resonance point of the ground and antenna line is produced.

4. The earphone antenna according to claim 1, wherein the plurality of the voice signal lines are connected to a connector assembly that is connected to a Printed Circuit Board (PCB) assembly housed in the receptacle.

5. The earphone antenna according to claim 1, wherein the other end of the receptacle is connected to an earphone line in at least one of a detachable means to the earphone line and as a one body to the earphone line.

6. An earphone antenna of a portable terminal, the earphone antenna comprising:

a plurality of voice signal lines;

an insulating sheath configured to cover an outer surface of the plurality of the voice signal lines;

a receptacle configured to connect to a first end of each of the plurality of the voice signal lines; and a ground and antenna line including a first antenna line configured to wind around an outer surface of the insulating sheath at a first interval in a spiral form, the first antenna line having a first thickness, wherein the ground and antenna line include a second antenna line configured to wind around the outer surface of the insulating sheath that is adjacent to the receptacle at a second interval in the spiral form, the second antenna line having a second thickness that is greater than the first thickness and the second interval being different from the first interval.

7. The earphone antenna according to claim 6, wherein the second interval is smaller than the first interval.

8. The earphone antenna according to claim 6, wherein the second interval is determined such that a resonance point of the ground and antenna line is produced.

9. The earphone antenna according to claim 6, wherein the plurality of the voice signal lines are connected to a connector assembly that is connected to a Printed Circuit Board (PCB) assembly housed in the receptacle.

10. The earphone antenna according to claim 6, wherein the other end of the receptacle is connected to an earphone line in at least one of a detachable means to the earphone line and as a one body to the earphone line.

* * * * *